US011965340B2

(12) United States Patent
Kandrashou

(10) Patent No.: US 11,965,340 B2
(45) Date of Patent: Apr. 23, 2024

(54) MODULAR TYPE SHADING FACADE

(71) Applicant: Cuby Technologies Inc, New York, NY (US)

(72) Inventor: Aleh Kandrashou, New York, NY (US)

(73) Assignee: CUBY TECHNOLOGIES, INC, New York, NY (US)

( * ) Notice: Subject to any disclaimer, the term of this patent is extended or adjusted under 35 U.S.C. 154(b) by 63 days.

(21) Appl. No.: 17/890,105

(22) Filed: Aug. 17, 2022

(65) Prior Publication Data

US 2023/0279667 A1 Sep. 7, 2023

Related U.S. Application Data

(60) Provisional application No. 63/233,911, filed on Aug. 17, 2021.

(51) Int. Cl.
*E04F 13/00* (2006.01)
*E04B 1/19* (2006.01)

(52) U.S. Cl.
CPC ..... *E04F 13/002* (2013.01); *E04B 1/19* (2013.01); *E04B 2001/1918* (2013.01); *E04B 2001/1936* (2013.01); *E04B 2001/1963* (2013.01); *E04B 2001/199* (2013.01)

(58) Field of Classification Search
CPC ..... E04F 13/002; E04F 13/083; E04B 1/19; E04B 2001/1918; E04B 2001/1936; E04B 2001/1963; E04B 2001/199
See application file for complete search history.

(56) References Cited

U.S. PATENT DOCUMENTS 5,033,901 A * 7/1991 Dias ..... E04B 1/1912 403/403
5,197,818 A * 3/1993 Johnson ..... E04B 1/19 403/217
5,203,428 A * 4/1993 Beeche ..... E04B 1/19 182/113
5,224,320 A * 7/1993 Mai ..... E04B 1/1903 52/81.3
6,904,720 B1 * 6/2005 Adolfson ..... E04G 21/24 52/762
2004/0088941 A1 * 5/2004 Boots ..... A47B 47/027 52/655.1
2014/0119811 A1 * 5/2014 Henniger ..... B21D 5/16 403/187
2015/0007522 A1 * 1/2015 Dobija ..... E04B 9/30 52/653.1

FOREIGN PATENT DOCUMENTS

CN 115492231 A * 12/2022

* cited by examiner

*Primary Examiner* — Patrick J Maestri
(74) *Attorney, Agent, or Firm* — Lawrence G. Fridman, Esq.; FEIGIN & FRIDMAN, LLC

(57) ABSTRACT

A modular shading facade spaced from a building wall includes multiple decorative modules. Each module is formed by a rigid frame with outwardly extending legs connected to the frame by multiple receiving brackets. Each receiving bracket has a base and a stepped region formed by two angle shaped parts disposed at an angle to each other to define an open space for receiving the respective leg. A primary bracket is defined by a base with a primary socket attached to the base for inserting said legs. The primary bracket is connected to a facade frame.

8 Claims, 14 Drawing Sheets

MODULAR TYPE SHADING FACADE

CROSS-REFERENCE TO RELATED APPLICATION

This application claims the benefit of priority from U.S. Provisional Patent Application Ser. No. 63/233,911 filed Aug. 17, 2021, the entire disclosure of which is incorporated herein by reference.

FIELD OF THE INVENTION

The present invention pertains generally to the construction industry and more particular it relates to manufacture and installation of shadow screen structures.

BACKGROUND OF THE INVENTION

In construction industry sunscreens have been used for various purposes including window solar screens, double facades, shaded facades (including controlled ones with various drives). U.S. Pat. No. 6,161,362 discloses a roof shading structure. U.S. Pat. No. 10,627,134 B2 teaches double facade heating and ventilation control. Also technically complex are the variety of rotary systems for creating shadows (US 2009/0320388 A1, US 2005/0022452 A1). Among major factors of a delay in the construction of the shaded facades are relatively high cost and complexity of installation and maintenance. However, more structurally simple and cheap shading facades also have a number of drawbacks.

Various structures containing tension screens are widely known. Their common features typically include a supporting frame structure (the most common frames are made of steel or aluminum), and the material stretched within these frames. Usually a semi-permeable plastic (mesh type PVC), as well as a tarpaulin or other shading fabrics are used for manufacturing of the screens. Common features of the erected shading facades are the relative constructive simplicity, reliability and cheapness of the. Examples of such designs are U.S. Pat. No. 9,512,670 B2 and US20170191262A1. The geometric shape of the surface of such shading facades is determined mainly by the shape of their frames.

Typically, majority of solar facades are mounted at a short distance from the outer building wall. For this reason, it is difficult to mount shading panels on facades having complex geometry. Also, it is quite difficult or impossible to provide shading facades where external units of air conditioners, satellite dishes are present.

Further, these shading screens cannot be erected if there are stairs and decks outside the rear of the buildings for maintenance of external enclosing structures or evacuation stairs.

Thus, it has been an acute need for a universal, easy-to-use, easy-to-handle shading system, which can also be placed on facades of complex shape, with installed air conditioners and other communications.

It has been also a need to update or repair facade screens without special equipment and the services of highly specialized labor, etc. There is a further need for a sun protection solutions, which are easy to maintain and repair, allowing a user to close facades of almost any shape and to provide quick access to its elements. The system of the invention is developed to satisfy these needs and requirements

SUMMARY OF THE INVENTION

The invention is aimed at simplifying the design, increasing the degree of factory readiness, increasing the installation rate, and expanding the architectural capabilities of the shading facade. The invention provides a shading facade of a modular type which incorporates the following technological solutions: a frame and a decorative module joined together, both vertically and horizontally, by fasteners located at the corners of these modules, into single entity of various configurations, shapes and numbers of floors.

This modular shading facade of the invention provides for placement of external blocks of various domestic devices, technical ladders and flooring for building maintenance (windows, roof, facade), as well as for more aesthetic appearance of the building.

The shading facade of the modular type boasts simplified design (the modules from which the structure is assembled have unified elements manufactured according to single technology and from the same material); increased degree of factory readiness (modules are 100% factory-assembled); increased installation rate (modules need to be just joined together into a single entity at construction site using fasteners); increase in design configuration options (due to joining together of modules of various dimensions, as well as possibility of their inclined placement).

The shading facade of the invention consists of reassembled elements: a framework module and a decorative module joined together into an architectural element. The modules of the shading facade can be of different dimensions, which allows one to shape various geometric forms necessary for creation of any fancy architectural design.

The frame module mainly consists of metal posts and crossbars, which can be supplied to the site as a single pre-assembled module or in elements. The decorative module consists of a spatial framework made of structural aluminum profile joined together with specialized fasteners (metal angle). Decorative material is stretched over the frame and affixed with a rubber tourniquet of circular cross-section.

Fixation of the decorative module on the frame of the shading facade is carried out using a sheet metal bracket. Lattice flooring and modular stairs are used for the maintenance of the shading facade. As for engineering networks, namely installation of an air conditioner external unit, a tubular steel frame bracket is used.

Installation of the modular shading facade is carried out on a floor-by-floor basis, its assembly starts with its placement on solid surface and connection of the framework modules at the same height in accordance with the project. The framework module consists of tubular steel or anodized aluminum elements and cross pieces made of 40×40 mm pipe bolted together through pre-drilled (cut-out) holes or welded flanges, with frame dimensions ranging between 500×500 mm and 3500×3500 mm with a width of up to 2000 mm. Protective polymer-powder coating is applied to all metal elements.

When assembling the shading facade for efficient and comfortable installation, a flooring made of galvanized lattice flooring is installed at each floor level.

After the assembly of the frame at a given floor level is completed, brackets for mounting decorative modules are installed at the module junctions. Decorative module framework consists of tubular elements joined together with the metal brackets. The decorative module framework dimensions are determined by the size of the framework module where it should be installed. At the frame corners, 600 mm lengths of square rods are attached at an angle of 90 degrees for attachment of frame to the elements of the shading facade. The decorative element of the module can be any material such as translucent PVC mesh, thick PVC film with (or without) UV printed pattern, tarpaulin, etc. Shading material is attached to the frame with a rubber harness pressed into the grooves of the profile.

The ladders may be located on different sides of the shading facade and made of 40×40 mm tubular steel for standards and 15×15 mm tubular steel for cross pieces. The ladder elements are interconnected by welding and painted with polymer-powder coating.

To fix the air conditioner external units, a tubular steel rack is fastened to the shading facade framework using bolts and nuts.

Features and advantages of the described shading facade are as follows:

1. Building operation and maintenance elements camouflage.
2. Increased construction rate using standardized elements and pre-assembled modules.
3. Broad range of facade designs by various quick-detachable decorative panels.
4. The possibility to implement various geometric facade shapes by 3-plane panel tilt (max 30°), and moving from the edge of the framework by 300 mm.
5. High resistance to wind load due to mesh structure of the web material.

BRIEF DESCRIPTION OF THE DRAWINGS

In the following drawings, the same parts in the various views are afforded the same reference designators. Referring now to the drawings which are provided to illustrate and not to limit the invention, wherein.

DETAILED DESCRIPTION OF THE INVENTION

Figure 1:
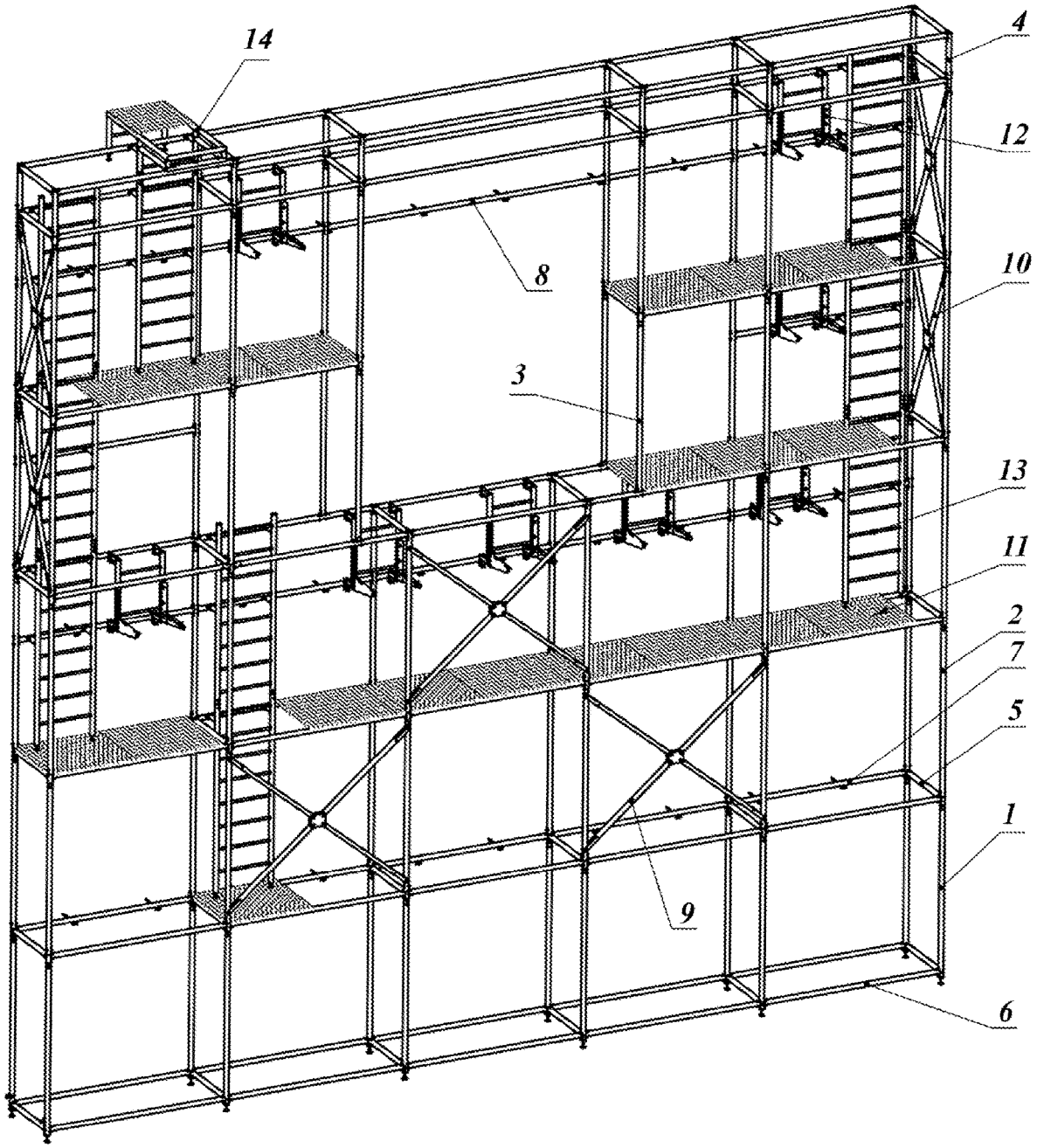
FIG. 1 is a general view of the shading facade frame.

The devices and methods discussed herein are illustrative of specific methods of making and using this invention only and should not be interpreted as an exclusive full description of the capabilities of the technology.

While the devices and methods are described herein with a certain degree of specificity, it should be noted that many modifications can be made to the design details and arrangement of the devices and components without departing from the spirit and scope of this disclosure. It is understood that the devices and methods are not limited to the embodiments set forth herein for purposes of illustration.

In general, the invention relates to a new, unique, lightweight modular shading system for building facades, which has an excellent appearance and has many applications. The system allows, in particular, to build a frame from ready-made modules floor by floor; a unique bracket allows you to adjust the distance between the shading screen and the bearing wall of the building, change the angle of the decorative shading elements relative to the vertical plane of the frame within certain limits, as well as place the necessary communications, remote elements of household appliances, gratings, stairs for people to move in the enclosed space, etc.

It is possible to simplify the manufacture/assembly of the shading facade according to the present invention. Most of the modules described can be assembled in five minutes or less, keeping labor costs at a reasonable level. All parts of the modules have standard dimensions and are made with sufficient accuracy, which are assembled into modules with the help of fasteners or even welding.

The system in the first approximation consists of a fairly rigid cellular modular frame (the shape of which is determined by structural and aesthetic considerations), which is completely or partially covered/surrounded by decorative modules, which in turn consist of a rigid frame, a shading/decorative material fixed on this frame, and as well as special square rods for fixing and adjusting the position of this decorative module in a specific cell of the shading facade frame using a special bracket.

Elements of the frame module and decorative module, as well as other necessary elements, can be solid or hollow and can be formed as one continuous "curved" frame for strength and uniformity, or a collapsible structure from parts (posts, crossbars, rods, diagonal braces). The frame can be made from a variety of materials such as galvanized steel pipes, aluminum, durable engineering plastic or fiberglass. If desired, you can also use some types of wood that have sufficient strength and load-bearing capacity, especially certified sustainable lumber. It is assumed that for the details of the frame and frame of the decorative module, a strong and lightweight galvanized steel pipe can be chosen. All the necessary connecting parts of the posts, longitudinal and transverse crossbars, diagonal braces can be welded (in the case of a steel pipe), screwed using fasteners (bolts or screws) if the material of the shading facade frame and decorative module frame is galvanized steel, structural plastic, aluminum or wood.

A description of the design of the facade shading system is given here using rolled metal (steel and aluminum) as an example. It is recommended to use a protective powder-polymer coating (for steel) or anodizing (for aluminum) when using this shade facade system in coastal, tropical or cold temperate regions. In the case of wood, it is recommended to use protective compounds against insect pests and weather factors.

The facade shading system consists of at least one frame module with a decorative module attached to it.

Referring now to FIG. 1, which is a general view of the shading facade frame for a wall of a two-story building with a flat roof and a parapet, a large panoramic window on the second floor, and without decorative modules installed on the frame, thus reflecting the numerous combinations of standard and special frame elements. The description is not exhaustive for this technology, only illustrates frequently occurring situations.

Among essential elements illustrated in FIG. 1 are a basic post with screw height adjustment 1, a standard intermediate post 2, a special post based on longitudinal and transverse crossbars 3, a shortened standard intermediate post 4, a transverse crossbar 5, a standard longitudinal crossbar 6, a longitudinal crossbar with the possibility of fastening to the wall of the building 7, a special intermediate longitudinal crossbar 8, a diagonal square brace 9, a rectangular diagonal brace 10, grating 11, an air conditioner bracket 12, stairs 13 and a roof access platform 14.

Figure 10:
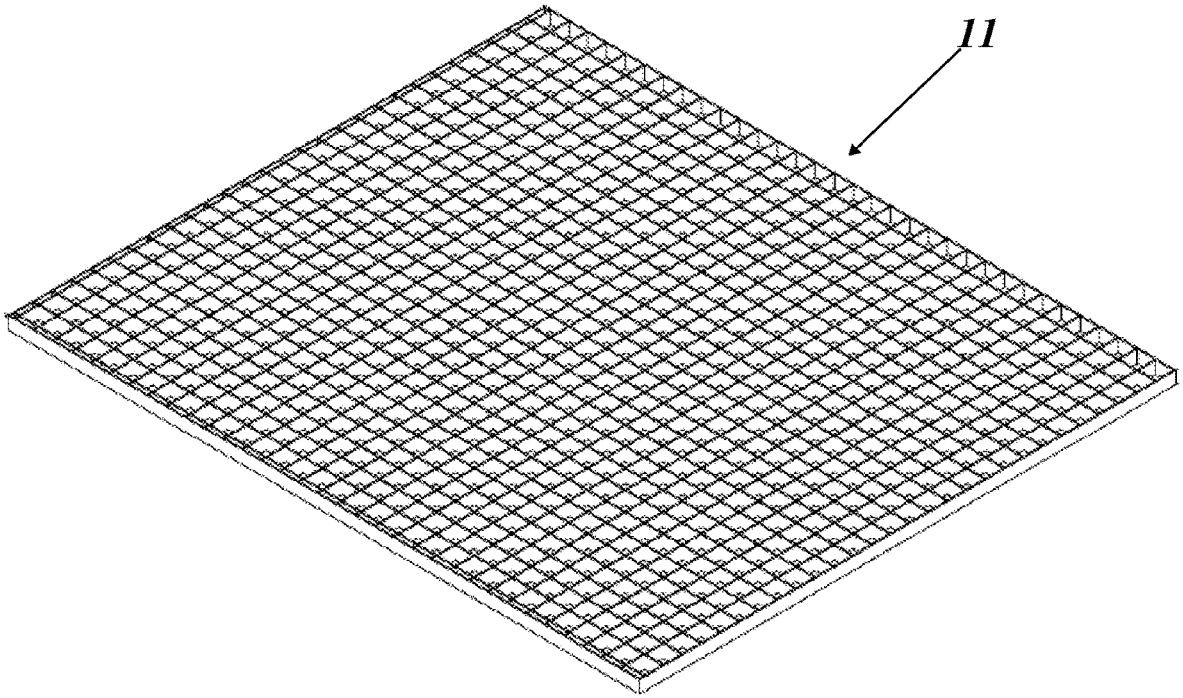
FIG. 10 is a view showing the grating.

The rigid modular frame of the shading facade is formed by vertical posts 1, 2, 3, 4 (see also FIG. 3 and FIG. 4), transverse bars 5, longitudinal crossbars 6, 7, 8 (see also FIG. 3 and FIG. 5), diagonal braces of square configuration 9 and diagonal braces of rectangular configuration 10 (see also FIG. 3 and FIG. 6), which determine the height, depth and width of the module 29, respectively. These elements after being connected together represent a supporting structure (frame), which, among other elements, may also include gratings 11 (see also FIG. 10), brackets for external blocks of household appliances 12 (see also FIG. 11), stairs 13 (see also FIG. 12); wherein other structures include, for example, a platform for access to the roof parapet 14, and having numerous points of fastening to the building wall.

Figure 2:
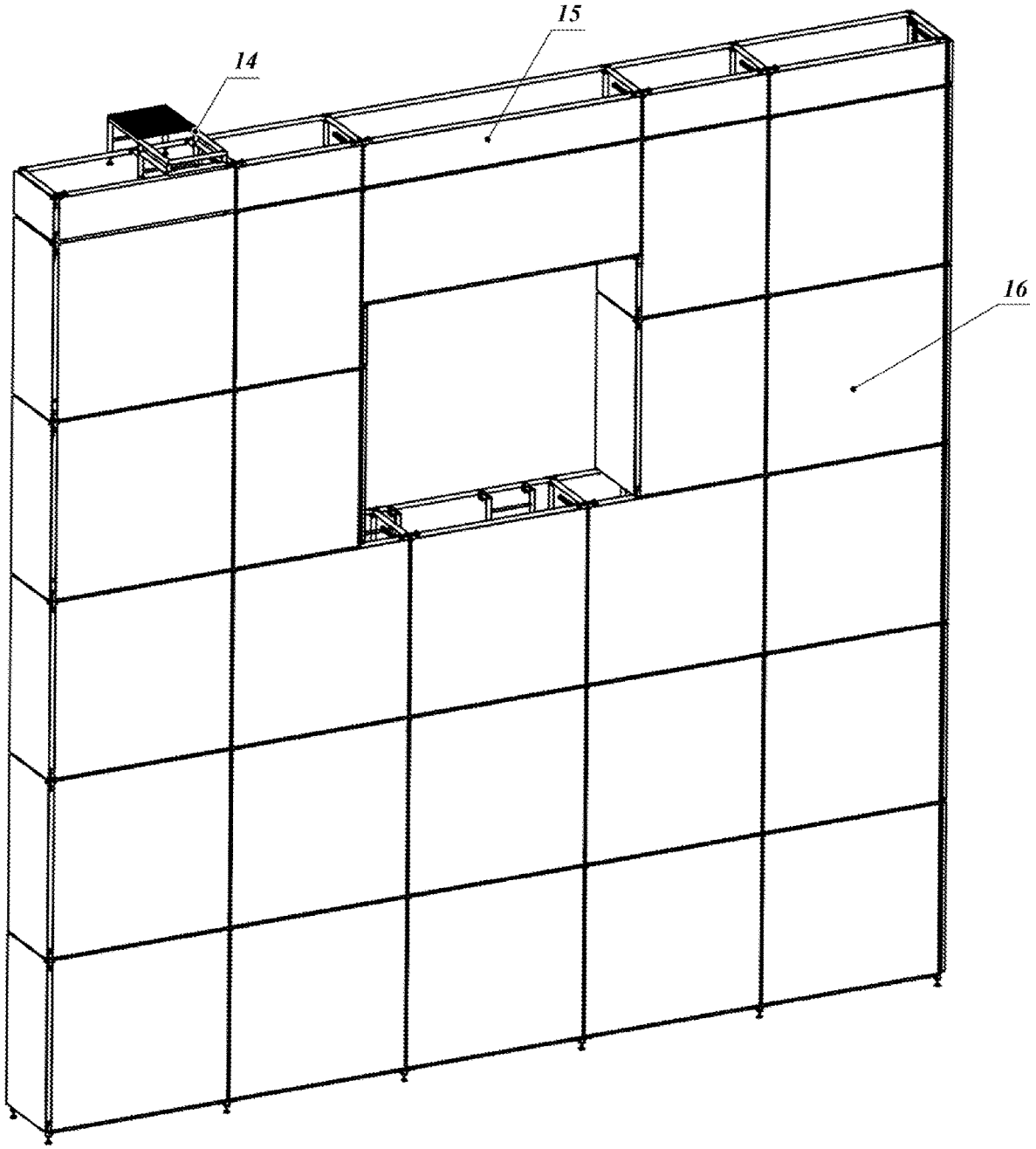
FIG. 2 is another view illustrating a general appearance of the shading facade.

The main functions of the frame include the adjustment of the position and fixation of decorative modules—individual elements, which include, for example, frame structures of various sizes and shapes (see also FIG. 2 and FIG. 7).

For ease of explanation, the invention also singles out the outer, peripheral plane (part) of the facade, formed by posts and longitudinal crossbars, to which decorative modules are attached, as well as the near-wall plane (part), the longitudinal crossbars and posts of which are attached directly to the wall of the building.

FIG. 2 is a general view of the shading facade for the wall of a two-story building with a flat roof and a parapet, a large panoramic window on the second floor, as well as a number of elements, including those included in the facade of the building, which are located inside the frame of the shading facade and which are hidden behind are decorative modules. There is also an area for access to the roof. FIG. 2 shows a rectangular decorative element 15 and a square decorative element 16.

FIG. 2 differs from FIG. 1 by a set of decorative modules installed almost over the entire area of the peripheral part of the frame of the shading facade, mainly, for example, having rectangular 15 and square 16 shapes. The above does not limit possible shapes and sizes of the decorative modules to the specified shapes.

Figure 3:
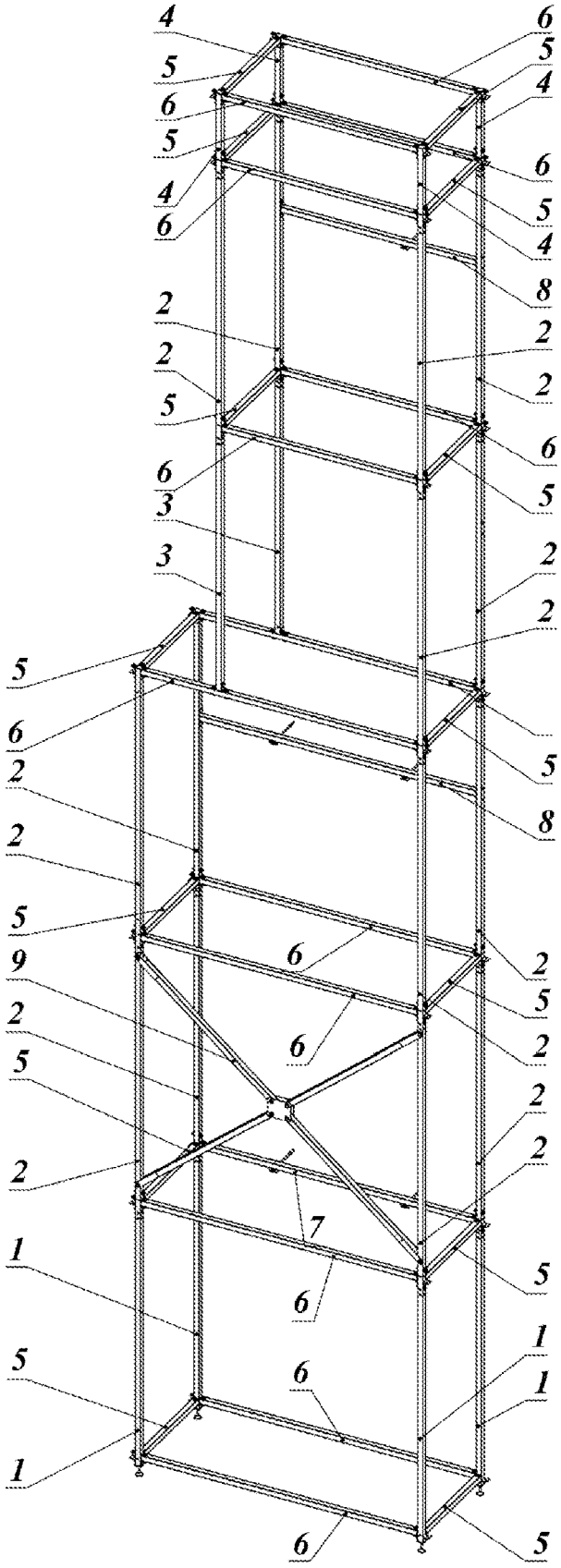
FIG. 3 is a view illustrating an embodiment showing a connection of the essential elements of the frame.
Figure 4A:
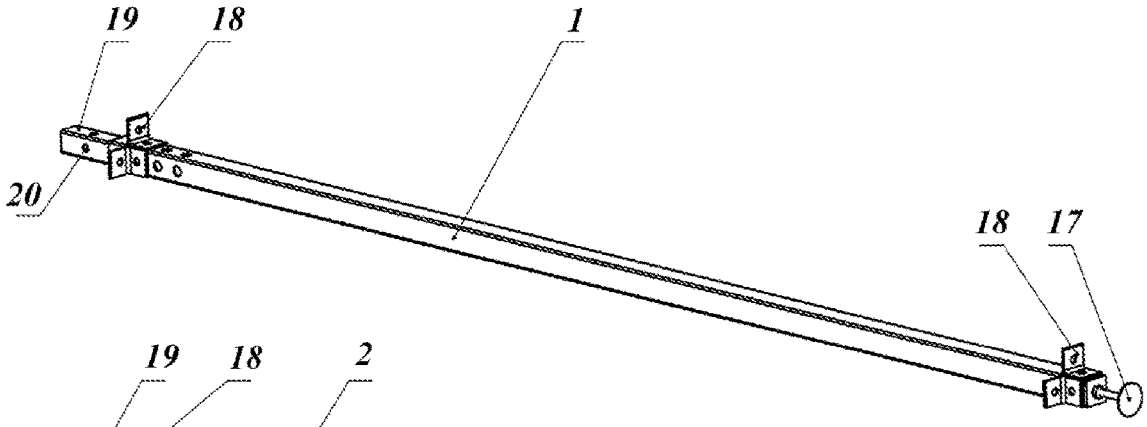
FIGS. 4A, 4B, 4C and 4D are the views illustrating various embodiments of vertical posts.
Figure 4B:
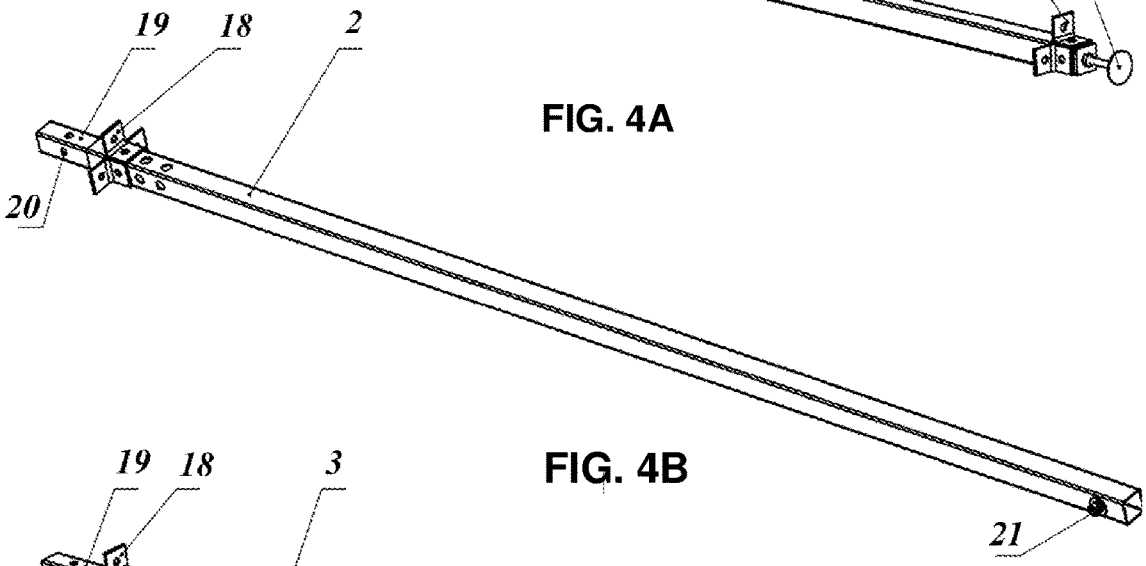
Figure 4C:
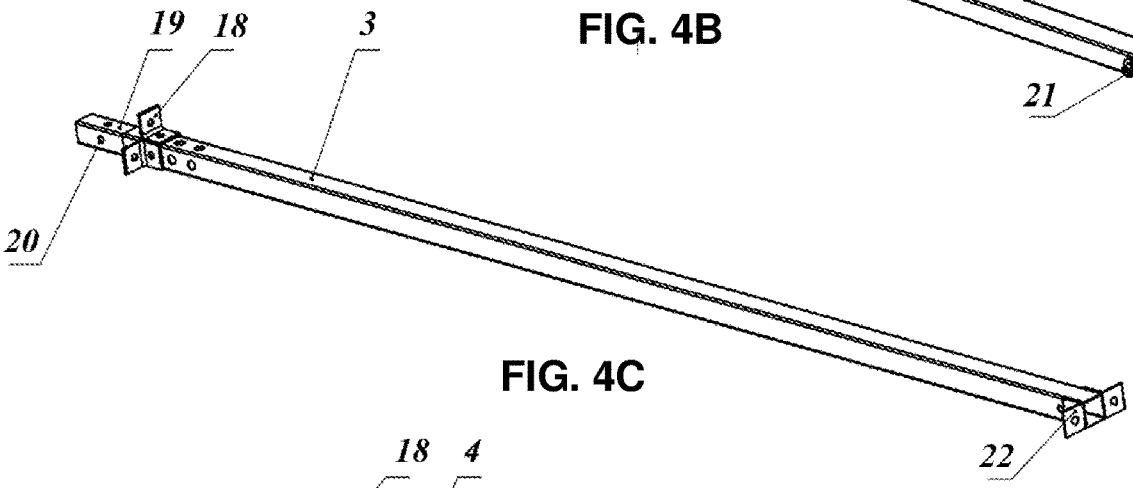
Figure 4D:
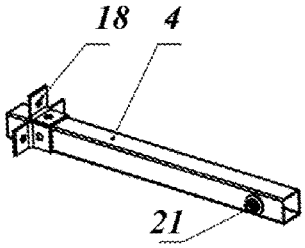
Figure 5A:
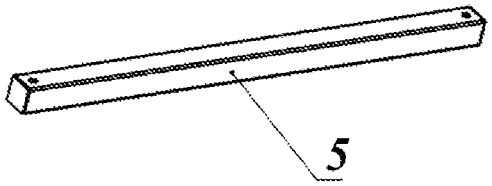
FIGS. 5A, 5B, 5C, 5D and 5E are the views illustrating various embodiments of longitudinal and transverse crossbars.
Figure 5B:
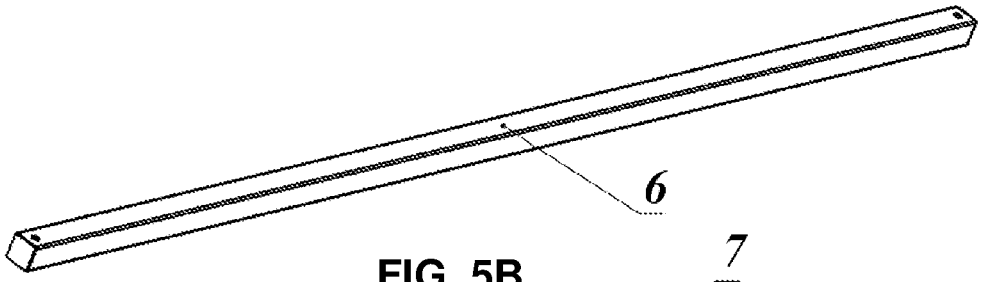
Figure 5C:
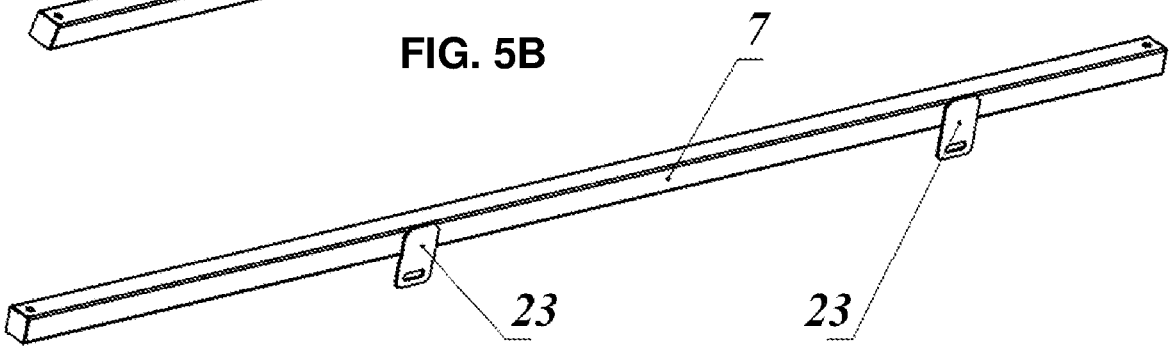
Figure 5D:
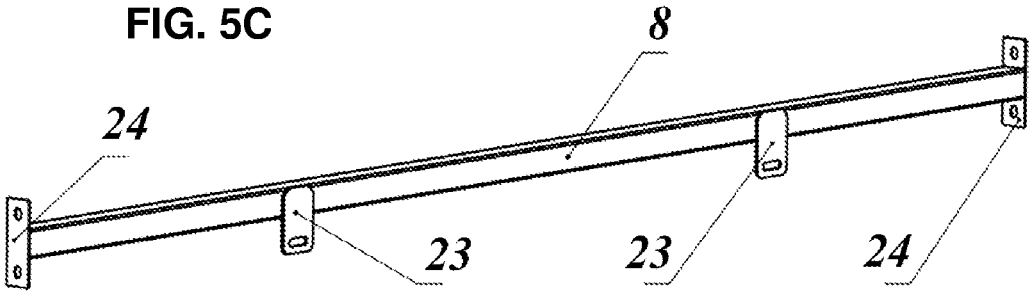
Figure 5E:
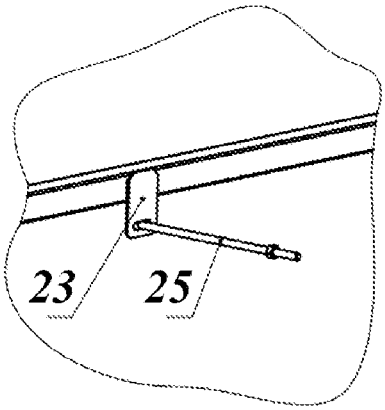

The frame illustrated in FIG. 3 consists of shells formed by posts 1, 2, longitudinal crossbars 6, 7, transverse crossbars 5 defining a simple three-dimensional frame. The frame also includes special cells, provided in addition to standard ones, which are formed by the following special elements, for example, posts 3, 4, longitudinal crossbars 8, and diagonal braces 9, 10.

Referring now to FIGS. 4A, 4B, 4C and 4D illustrating various embodiments of vertical posts. Among essential elements illustrated in these figures are a screw height adjustment 17, corners for fastening longitudinal and transverse crossbars 18, a spacer for connection with the next post 19, a hole for bolted connection with the next post 20, a hole for bolted connection with the previous post 21 and corners for basing on longitudinal and transverse crossbars 22.

Posts 1 of the first, basic level are installed directly on the blind area of the building or on a special foundation designed and installed in accordance with local building codes. In one embodiment of the invention, elements of the posts, longitudinal and transverse crossbars can be made of steel square-shaped pipes. The design of the posts of the base level involves screw adjustment 17 (FIG. 4A) provided to adjust the height of the rack on a solid foundation (or building blind area, etc.). The installation of longitudinal and transverse elements is carried out on the mounting angles 18 using conventional fasteners. Unlike standard and intermediate posts of the frame, the base post 1 has an additional set of mounting angles 18 for attaching standard longitudinal and transverse crossbars of the lowest level, at the base of the frame.

Holes for attaching additional, special longitudinal and transverse crossbars and diagonal braces can be drilled during the manufacture of products at the enterprise according to the project or directly at the installation site, depending on the configuration.

Standard posts 2 of the next levels do not need screw adjustment, so their design is simpler. The extension of additional posts of all types to increase the height of the frame one level up is carried out, for example, by installing the next, upper post onto a special narrow part of the previous, lower post. The latter is formed by a spacer 19, followed by fixation using a clamp passing through both connected posts of the fasteners 21, i.e., through a hole in the spacer 19 of the lower post and the hole 20 in the upper post. Attachment (by welding for example) of a metal connecting spacer to the main pipe of the rack during the manufacture of the products or directly at the installation site, depending on the configuration, is carried out, for example, through holes under the upper mounting angles.

Post placement is not always taking place on the concrete base or spacer of the previous post. In such instances, a modification of the post 3 is used, where, for example, two mounting angles 22 are welded from below to fix the post with, for example, fasteners to the supporting elements of the frame, for example, longitudinal/transverse crossbars.

To complete the appearance of a shading facade, a post with a non-standard height may be required, such as the post 4 on the last level of the facade. Such post can be formed from a standard intermediate post 2 by cutting the element to the desired length and drilling a hole for the bolted connection 21 at the assembly site. If necessary, mounting angles 18 can be added in the right combination for a specific post.

Basically, use any combination of connection options, both the same at both ends of the post, and different ones, including those not specifically described are within the scope of the invention.

Referring now to FIGS. 5A, 5B, 5C, 5D and 5E illustrating various embodiments of longitudinal and transverse crossbars. Among essential elements illustrated in these figures are brackets for fastening to the facade 23, plates for fastening of the intermediate crossbar to vertical posts 24 and a stud fixed in the wall of the building 25.

As noted above, the mounting angles 18 of the posts of the frame are elements for fastening standard transverse crossbars 5, and longitudinal crossbars 6, 7, which have holes for bolted connection at both ends of the pipe. Standard and special transverse crossbars are identical in design and set of functional elements with standard and special longitudinal crossbars, they differ mainly in a significantly shorter length.

The design of standard longitudinal and transverse crossbars, as in the case of standard posts, can be of various lengths. It is also possible to cut these elements to the desired size with drilling new mounting holes, if necessary, for example, at the assembly site. It is also possible to use special brackets 23 for fastening the crossbars from the near-wall plane of the frame to the wall of the building with using a stud 25 fixed at one end in this wall, while its other end is threaded through the bracket 23 and fixed, for example by tightening the nut.

Special horizontal elements such as longitudinal crossbars 8 can be either identical in length to standard ones or different. Also, if necessary, such elements can be supplied with brackets 23 for similar fastening to the wall by the stud 25. Special longitudinal and transverse crossbars are attached to the vertical posts, for example, by means of a bolted connection through brackets 24 at both ends of the crossbars. Holes in vertical posts for screwing brackets 24, using, for example, bolts, can be drilled directly at the assembly site. Special crossbars 8 are usually used in the near-wall plane of the frame, for example: a) changing the height of the opening in the facade frame, for example, for windows and doors; b) support of hinged elements inside the shading facade in near-wall space, for example, brackets for the external unit of the air conditioning system (FIG. 11), antennas, as well as stairs, (FIG. 12); c) including for fixing the crossbar and, thus, the entire frame to the wall of the building using special brackets 23 and studs 25 fixed in the wall as described above (FIG. 5).

Posts, longitudinal and transverse crossbars, or their parts, can also form separate functional structures, for example, the platform frame 14 for accessing the roof from a shading facade, while simultaneously combining in its composition, for example, a frame structure, grating and stairs.

Basically, use of any combination of connection options, both the same at both ends of the longitudinal or transverse crossbar, and different ones, including those not described here, is within the scope of the invention.

Posts with longitudinal or transverse crossbars are connected, for example, using bolted fasteners, primarily for the possibility of changes and disassembly of the frame. However, other methods are also contemplated, including welding if metal is used as the main frame material.

Figure 6:
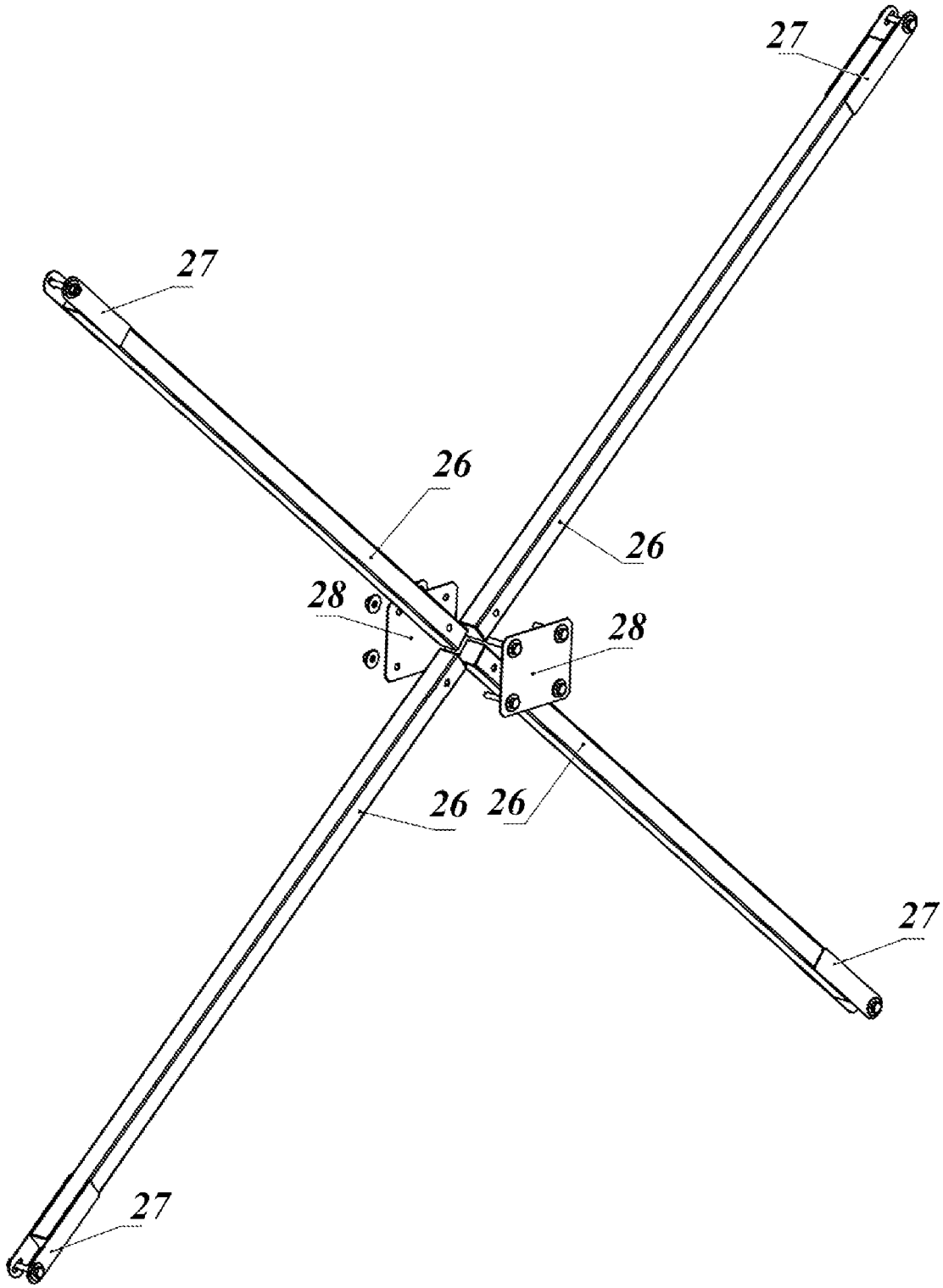
FIG. 6 illustrates an embodiment of a diagonal brace.

The diagonal brace illustrated in FIG. 6 includes a brace element connected to the elements of the facade frame 26, plates for attaching to the elements of the facade frame 27 and plates for assembling the brace elements into the final product 28.

For additional vertical (and sometimes horizontal) structural rigidity, diagonal braces are installed in multi-level frames, for example, square shaped 9 or rectangular shaped 10 braces (FIG. 1, FIG. 3, FIG. 6). These configurations are the most common, but the capabilities of the technology are not limited to them. Typically, the need for diagonal braces arises when there are three or more levels in the frame structure vertically and/or horizontally, as well as the complexity of the structure or specific environmental factors, for example, when building shading frames in regions with strong winds. Structurally, diagonal braces can be formed by, for example, four separate metal pipes 26, each having a pair of plates 27 welded on one side for bolting, for example, with vertical racks of the frame, and with a through round hole on the other side (FIG. 6). The through hole is used for twisting four separate tubular brace elements into a single diagonal brace element using two plates 28 fasteners. If necessary, it is also possible to cut pipes to the required size. Thus, it is possible to obtain diagonal braces of rectangular, square, as well as trapezoidal, diamond-shaped and several other shapes. It is also possible to use diagonal braces for the following purposes: a) connecting vertical posts, both separately peripheral and separately near-wall parts of the frame; b) connections between posts from the near-wall part of the frame with vertical posts of the peripheral, outer part of the frame; c) interconnecting longitudinal and/or transverse crossbars of the near-wall and peripheral parts to give the frame horizontal rigidity, for example, in the absence or insufficient number of gratings. It is also possible to manufacture diagonal elements of any other design and/or other suitable materials with other methods of assembly and fastening.

Parts of the shading facade frame can be supplied both assembled and as separate elements. As a finished product, assembled and fixed to the building facade, the shading facade frame is one/multiple frame cells, mainly used to install and adjust the position of one/multiple decorative modules (panels) (FIG. 2 and FIGS. 7A and 7B).

Figure 7A:
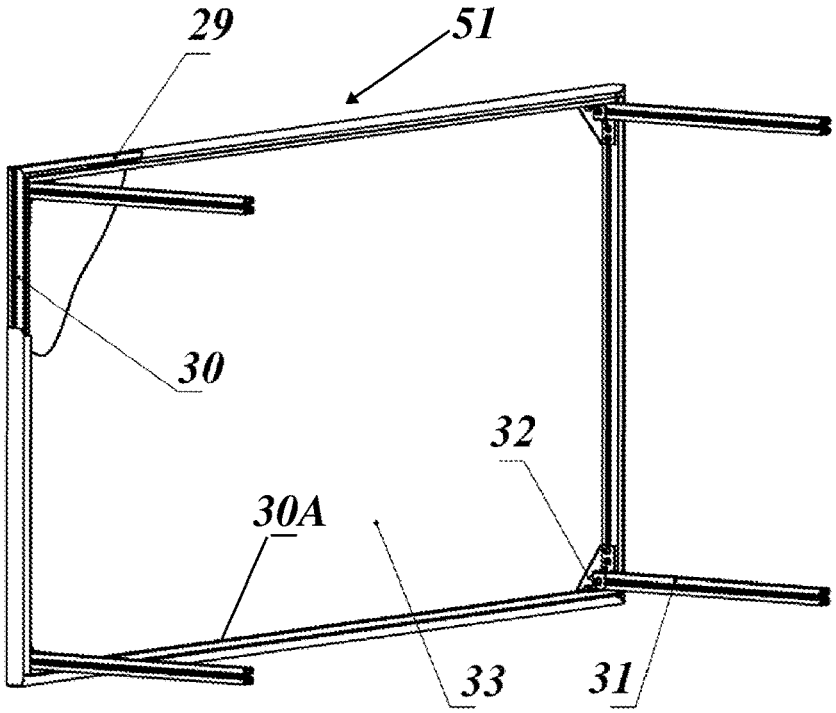
FIGS. 7A and 7B illustrate a decorative module of the invention.
Figure 7B:
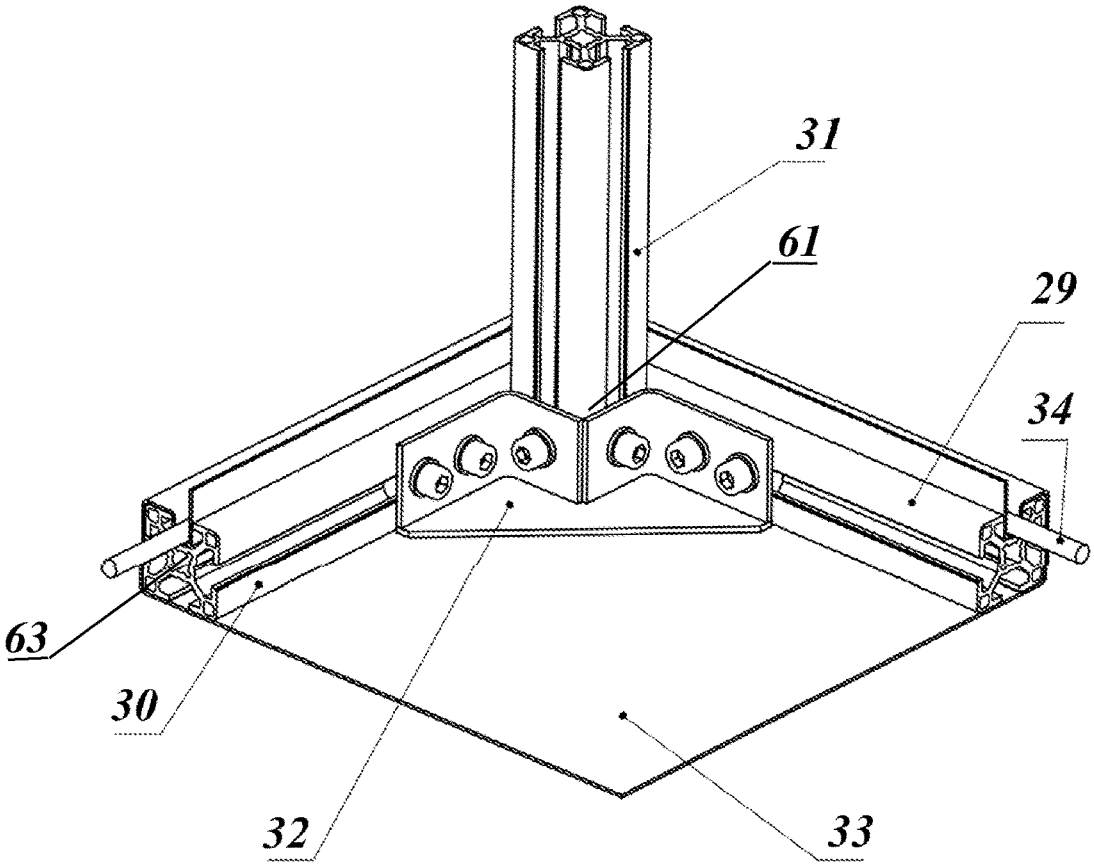

The decorative module shown in FIGS. 7A and 7B comprises a horizontal element of the frame 30A, a vertical element of the frame 30, a plurality of legs 31 each accommodated by a respective receiving bracket 32, a stretched decorative material 33 disposed within the frame and a resilient cord 34.

As illustrated in at least FIGS. 7A and 7B a decorative module 29 include a rigid frame 51. Also, the frame is typically made of metal, the disclosed shapes and materials are provided only as an example of a shading facade system. The module 29 consist of linear segments 30 and 30A forming a periphery of the frame 51, with outwardly extending legs 31 connected to the frame by means of multiple receiving brackets 32. In the illustrated embodiment four receiving brackets 32 are provided, one at each corner of the frame. Other arrangements are within the scope of the invention. As an example, these segments can be made using an anodized aluminum extrusion profile, for example 40×40 mm in size.

As discussed in the application, in addition to be a part of the frame 51 periphery used in the decorative module 29, the receiving bracket 32 are also adapted to accommodate the legs 31 used to adjust and fix the decorative module 29 within the shading facade. This occurs by inserting the legs 31 into a primary bracket 57 (see FIGS. 8A, 8B, 8C, 8D and 14) to a predetermined desired depth (FIG. 9).

Figure 13:
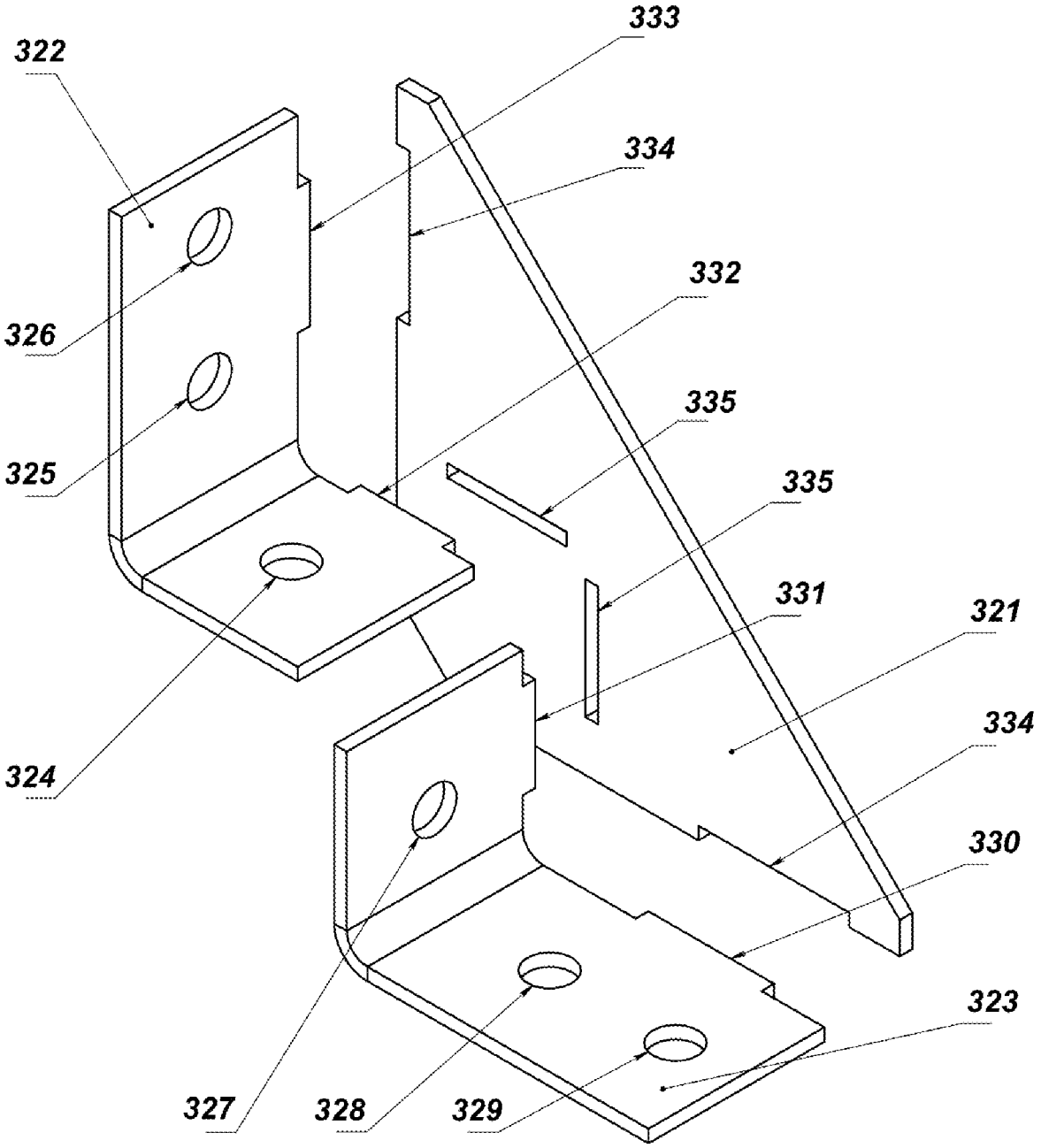
FIG. 13 is an exploded view of the receiving bracket.
Figure 14:
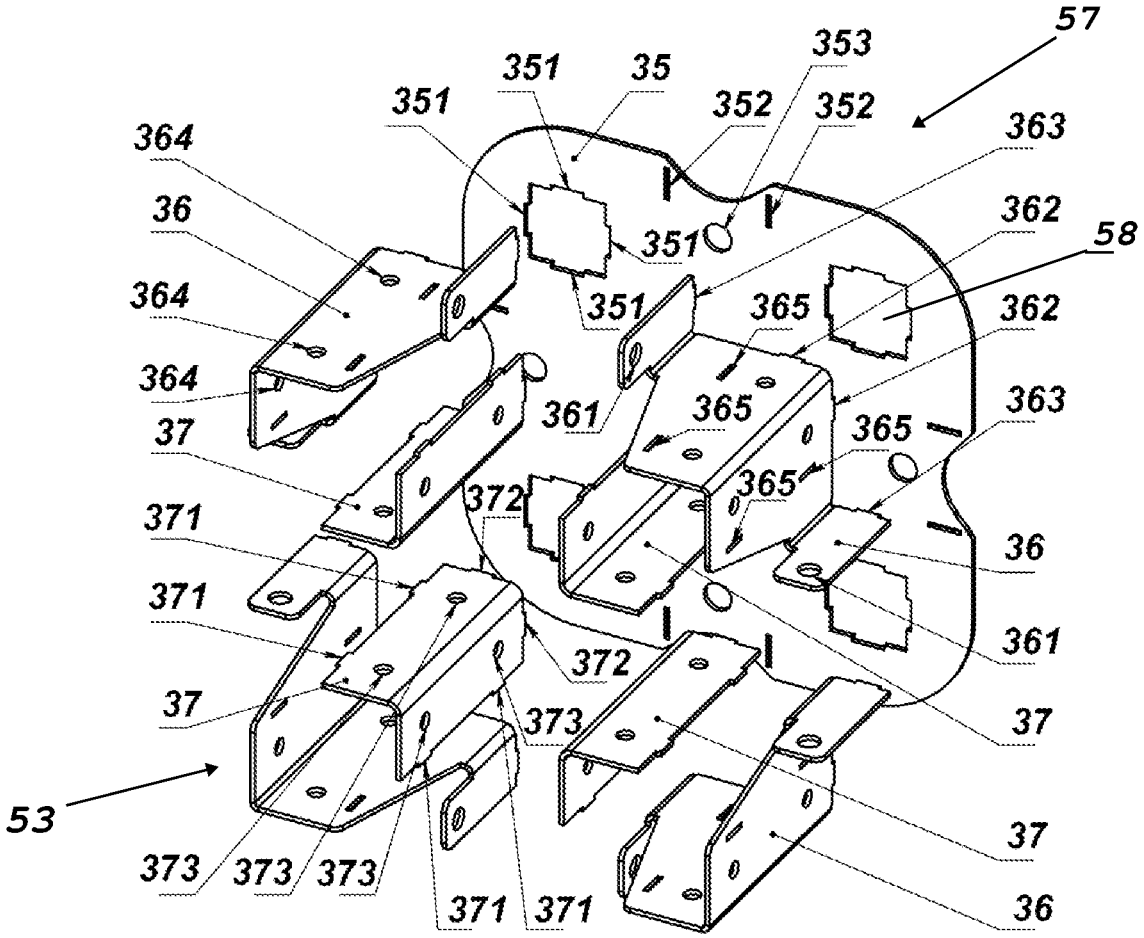
FIG. 14 is an exploded view showing the primary bracket assembly.

Referring now to FIG. 13 which illustrates the receiving bracket 32 assembly in better detail. It is essential to provide a unit capable of being assembled and disassembled as need requires. The receiving bracket 32 has a flat base 321 and a stepped region formed by two angle shaped parts 322 and 323 connected thereto. In the assembled condition these parts are disposed at an angle to each other normally to the plane of the base 321, so as to define an open space 61 for receiving/insertion of the respective leg 31. The part 322 has holes 324 for receiving fasteners (see FIG. 7B) forming a removable connection with the legs 31. Holes 325 and 326 are also provided for removable connection of the part 322 to the frame of the decorative module 29.

Similarly, a part 323 has a hole 327 for removable retaining the leg 31 and holes 328 and 329 for removable connection of the part 323 to the frame of the module 29.

The removable connection also involves the part 322 being provided with projections 332 and 333 for insertion into slots 335 and 334 of the base 321, respectively. Further, to assure the removable nature of the connection, protrusions 330 and 331 are also inserted into the grooves 334 and 335 of the base 321.

In this case, the flat base 321 of the receiving bracket faces surface of the stretched decorative material, thus preventing the end part of the legs 31 from damaging the material/fabric 33.

Segments 30 and 30A formed with a semicircular or square grooves 63 along the entire length thereof are utilized for stretching suitable, relatively soft and hard materials/fabrics 33 over the entire area of the frame. This is needed to provide partial or complete shading of the facade. Fixation of the position of the stretched material or fabric 33 to the frame is carried out by their pressing into the grooves 63. In such application, after placing an edge of the material/fabric into the respective groove, a resilient cord 34, having a diameter equal to or slightly smaller than the depth of the groove 63 is inserted there inside. Thus, the resilient cord 34 presses and retains the stretched edge of the material within the groove along the entire perimeter of the frame of the decorative module 29. This provides a secure fixation of the material without damaging its integrity, and also allows repeatedly and quickly mount and dismantle the material or fabric. It should be noted that attaching the stretched fabric to the frame of the decorative module 29 by any other convenient and accessible way is within the scope of the invention.

The primary bracket 57, illustrated in FIGS. 8A, 8B, 8C and 8D, includes among other elements a perforated metal base 35, a primary socket 36 for inserting the legs 31 and a plate 37 for attaching the bracket to the facade frame.

Figure 8A:
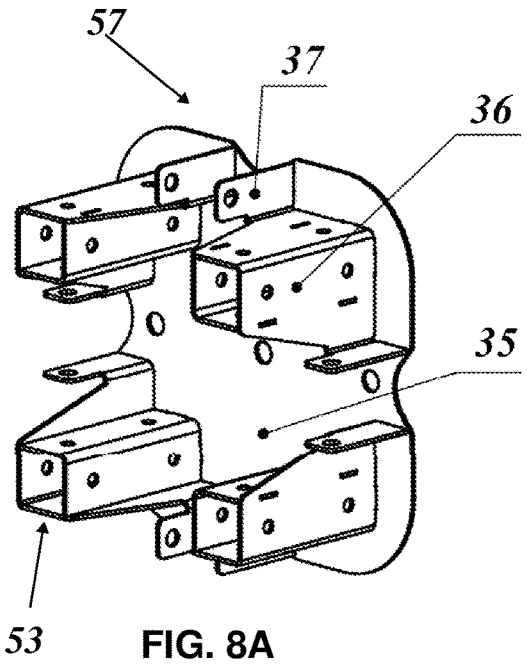
FIGS. 8A, 8B, 8C and 8D show various views of a primary bracket for the decorative modules of the invention.
Figure 8B:
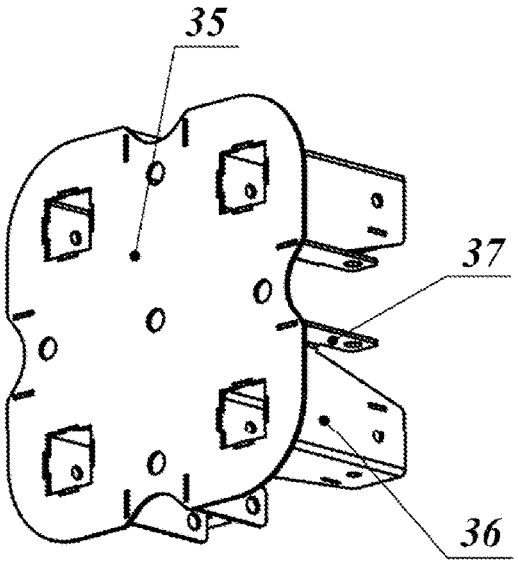
Figure 8C:
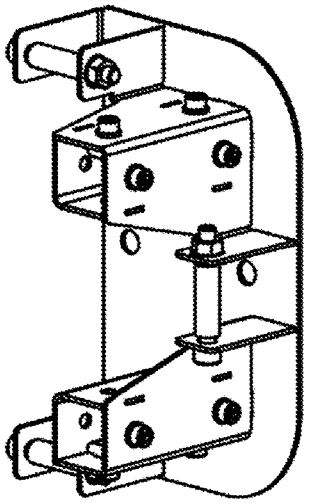
Figure 8D:
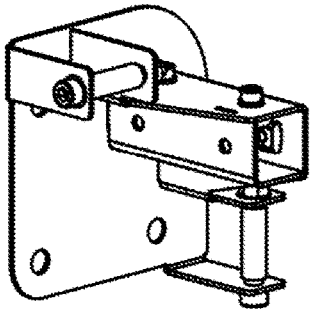
Figure 9:
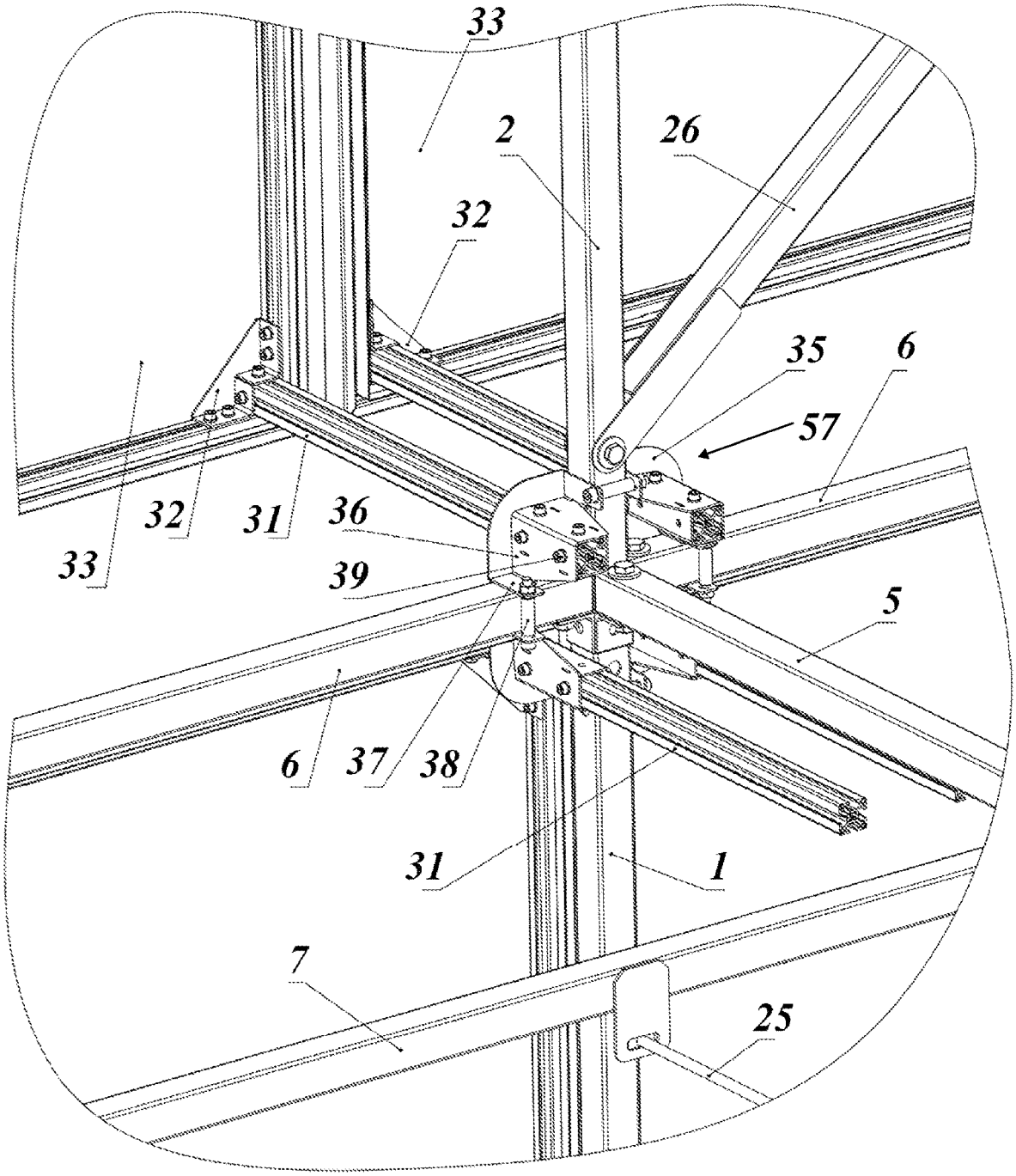
FIG. 9 is an assembly view illustrating fastening and adjusting the decorative modules.

Referring now to FIGS. 8A-8D and 14 illustrating primary brackets 57 which are located in the peripheral plane of the frame at the junction of the elements of the posts, longitudinal and transverse crossbars, and sometimes also diagonal braces. The primary bracket 57 assembly consists of a flat perforated plate 35 provided with sockets 36 for receiving the legs 31 and plates 37 for attaching the bracket to the elements of the peripheral part of the frame. This can be accomplished by for example, by covering the vertical post and/or longitudinal crossbar and/or transverse crossbar using, for example, a fastener 38. The number of sockets is determined by the location of the bracket 57 (FIG. 8A). Four sockets are used at the junction of four adjacent cells of the shading facade frame; two-sockets brackets are used at the junction of two cells; brackets 57 with one socket are used in the corner of the cell of the peripheral plane of the frame. The leg 31 is fixed in a predetermined position of the socket 36 by tightening the fasteners 39.

The primary brackets 57 also serves as guides for adjusting the position of decorative modules 29 relative to the vertical plane of the frame of the facade shading system (FIG. 9).

As more specifically illustrated in FIGS. 8A-8D and 14, the primary bracket 57 is formed with a substantially flat base 35 with a plurality of through openings 58 of various shapes and sizes provided to accommodate respective sockets 53. Each socket 53, when assembled, is formed by interconnected angle shaped elements 36 and 37 and is fixedly connected to the base 35.

The assembly illustrated in FIG. 9 for fastening and adjusting of the decorative modules includes at least a fastener 38 for fixing the bracket on the facade frame and a fastener 39 for fixing the legs 31 in the socket 36.

Each socket 53 is defined by three regions interposed at an angle to each other, an eyelet with a hole 361 is provided for fixing to the uprights and rungs of the shading facade frame using a fastener 38 (see FIG. 9). A portion of the element 36 in conjunction with an element 37 forms the socket 53 adapted for receiving the legs 31 of the decorative module 29.

When assembled the elements 36 and 37 are interconnected to form a continuous nest having a square or rectangular cross-section by inserting four protrusions 371 of the element 37 into the slotted grooves 365 of the corresponding element 36. The resulted structure can be permanently fixed by any conventional means including spot or continuous welding.

After the primary socket 53 is assembled, it is placed using multiple protrusions 362 and multiple protrusions 372 into recesses 351 at edges of the openings 51 in the base 35, as well as by positioning of protrusions 363 into the grooves 352 in the base 35.

The elements 36 are provided with four holes 364 to accommodate fasteners 39 for clamping the leg 39. For example, this can be done with a T-shaped nut in the case of using a square a cross section aluminum profile for the leg 31.

Four holes 373 can also serve for a similar purpose. There are multiple holes 353 are formed in the base 35 for additional fixation of the base 35 to the posts and beams of the frame of the shading facade The length of the legs 31, which can be in the form of rods having square-shaped cross-section, is up to 600 mm. Adjusting the position of the decorative module 29 using the legs 31 includes setting the distance of each corner of the decorative module from the surface of the base 35, that is, the angle between the surface of the decorative module 29 frame and the peripheral plane of the shading facade's frame. Distance adjustment is carried out by inserting the legs 31 into the bracket 36 of the primary bracket 57 to a certain depth. The fixation of the predetermined position is carried out, for example, by clamping the fasteners 39 after the required position is set. To restore the possibility of adjusting such position, it is enough to loosen the fasteners 39. As illustrated in FIG. 9, the corners of the frames of the "lower" decorative modules 29 are as close as possible to the bracket base 35, and the two "upper" corners of the decorative modules are as far away from the frame as possible. The latter is illustrated by the legs 31 associated with "upper" corners to be fully outwardly extended from the base 35. Changing the depth of insertion of the legs 31 into the socket 36 of the corresponding primary bracket for one of the four legs 31 for each corner of the decorative module 29 allows it to adjust, to a certain extent, the deviation of the decorative module 29 from the peripheral plane of the frame module 29 by a certain angle. This provides a variety of geometric shapes of the shading facade, turning even vertical surfaces into a variety of forms. Installing and adjusting the position of decorative modules does not depend on the shape and size of the frame of the decorative module 29.

The decorative module 29 can be decorated with various materials, in particular, various types of semi- or impermeable, resistant to environmental factors, artificial polymer fabrics, as well as those made from natural raw materials, for example, translucent reinforced PVC, linen fabric etc. These examples do not limit the range of possible materials, in fact, it is possible to use a material/fabric that are sufficiently flexible ("elastic") so that the material/fabric can be stretched over the frame of the decorative module 29 and, with temperature changes, the material returns to its original shape. The material/fabric, after being pressed into the frame of the decorative module 29, should become self-tensioning, for example, due to its ability to slightly stretch and enclose the rigid frame of the module 29 of various sizes. The flexibility and slight "flexibility" of the preferred materials/fabrics for facing the frame of the module 29 will allow them to be stretched over any configuration of the frame of the decorative module 29. According to the inventor's knowledge, such modular decorative panels are unique and innovative as panels of this type have never been made from this material before (e.g., shading materials/fabrics used in horticulture, outdoor furniture fabrics, etc.). The width and length of the piece of fabric must exceed the width and length of the frame of the decorative module 29 by at least 150 mm in each change, it is also recommended to make square cutouts at the corners of the piece of fabric to facilitate wrapping the vertical and horizontal elements of the frame with the edges of the canvas.

Double or even triple overlay of materials/fabrics on each other can be performed before installing a decorative module 29 on the frame to give the canvas higher performance properties.

The material/fabric for the decorative module can be covered in different colors, have a three-dimensional (3D) texture, or combine different types of materials/fabrics, or a combination of colors/material types of the same kind.

For energy efficiency, environmental purposes, or other considerations, a material/fabric may be a single, versatile, high-performance material (or material of a single color). Logos, messages and/or any images can be applied to the decorative module material/fabric, for example by UV printing or by any other available method. Decorative modules can be swapped seasonally to increase the efficiency of the module and/or extend the life of the module as a whole or any of its components. Decorative modules do not have to be installed exactly parallel to the wall or other surfaces, they can be installed to a certain extent at any angle and at various distances from the peripheral surface of the facade frame, if necessary for decoration, durability, maintenance, performance or other reasons.

The shading facade, created by one or more decorative modules with a stretched semi-permeable or almost impermeable fabric, creates a volume around the shading surface of the building with a relatively slow-moving air space, the volume and thickness of which depend mainly on the depth of the selected frame. Thus, the volume of air enclosed in this space can also be used as an additional thermal insulator, similar to its use as part of double facades.

From the study of majority of materials it appears that most of the infrared heat is absorbed by the surface of the decorative module, namely on the canvas, and does not pass through it.

A substantial amount of air space inside the facade shading system can be created by increasing the depth of the frame module, i.e., increasing the distance between the near-wall plane of the shading facade and the peripheral plane formed by the surfaces of decorative modules. An increase up to approximately 2000 mm can be achieved: a) by using elongated (up to 1500 mm) transverse crossbars 5 as part of a rigid facade frame; b) due to extension into the outer space relative to the peripheral plane of the modular frame frames of decorative modules 29 (FIG. 9) by maximum outward protrusion of the corner square rods 31 of the decorative module 29 from the socket 36 of the bracket.

With a sufficiently wide gap developed between the wall of the building and the shading facade, it is possible to place gratings in the resulting space (FIG. 10) to accommodate horizontal movement of people. The gratings can be used industrially, selected according to the size and preferences of the user. The gratings are fastened to the elements of the shading facade frame, for example, using long self-tapping screws with a drill or bolts, drilling the necessary holes at the installation site, or by welding.

Figure 11:
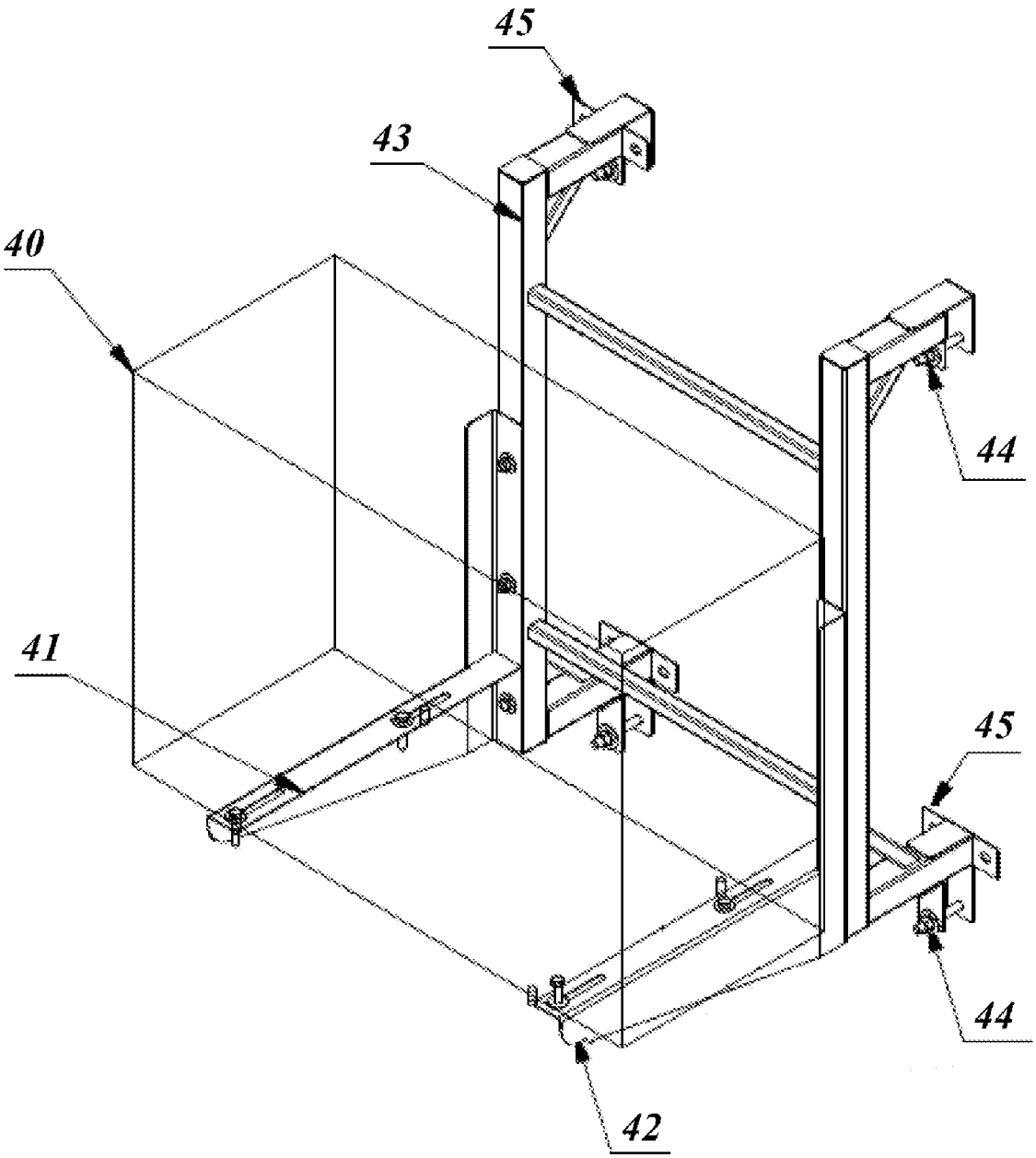
FIG. 11 is a view illustrating a bracket for an outdoor unit of a split system for air conditioning.

Among essential elements of FIG. 11 illustrating a bracket for an outdoor unit of a split system for air conditioning are: a right bracket 41, a left bracket 42, a tubular frame 43, a bolt 44 for fixing the tubular structure on the facade frame and a plate 45 for fixing the tubular structure on the facade frame.

By increasing the distance between the wall of the building and the shading facade also makes it possible to place in the resulting space, for example, brackets for external units of household air-conditioning split systems (FIG. 11), without compromising the external aesthetics of the building. As a rule, these elements are placed on the near-wall space of the facade frame. Such brackets may, for example, consist of metal pipes and sheet steel parts. The outdoor unit of the domestic split air-conditioning system is mounted on two brackets 41 and 42, which are then bolted to the pipe structure 43, with the ability to be attached with the upper and lower set of brackets to the crossbars 6, 7 or 8, both by covering the crossbar and subsequent tightening of the bolt 44, and bolts through the plates 45 into the holes drilled in the crossbars.

Figure 12:
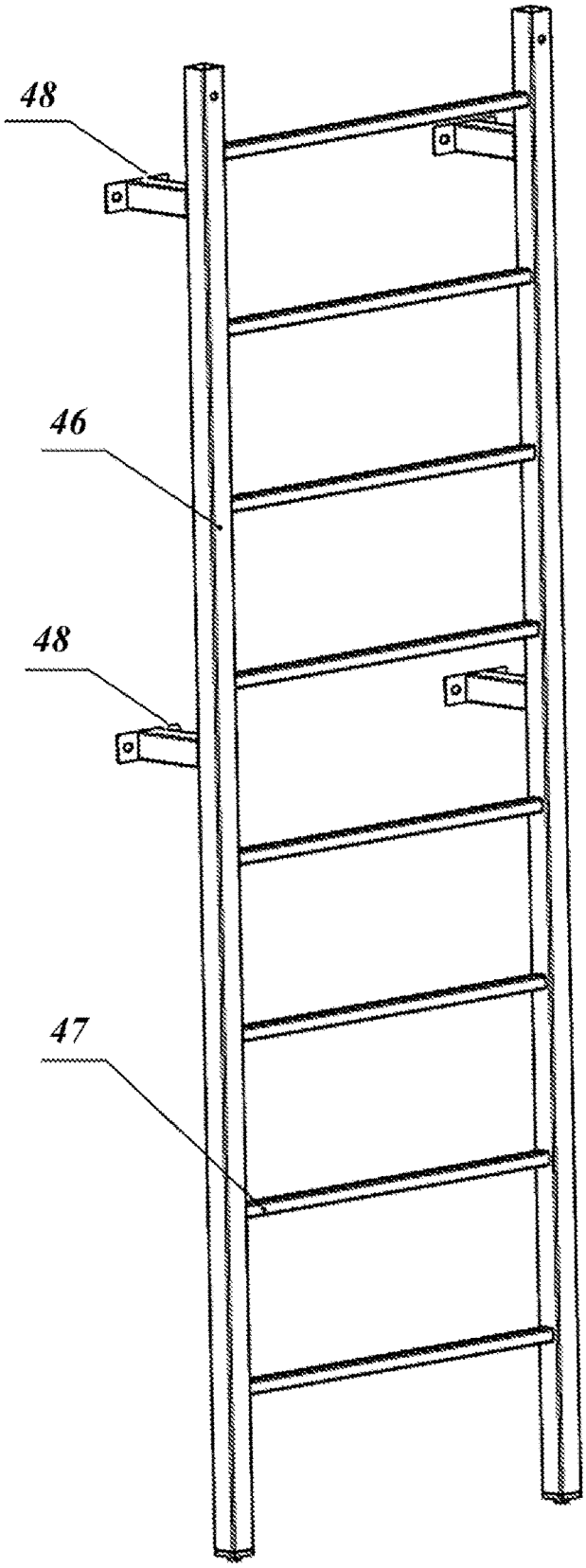
FIG. 12 is a view showing a vertical ladder.

Among essential elements of FIG. 12 illustrating a vertical ladder are: a vertical rack of the stairs 46 and steps 47 and a bracket 48 for fixing the stairs on the facade frame.

Together with gratings it is also convenient to place, for example, stairs (FIG. 12)—for vertical movement of people, maintenance of external communications and building elements, including elements of a shading facade. Typically, stairs are placed in the near-wall space of the facade frame, supported by gratings and/or transverse crossbars (FIG. 1). Flights of stairs can be located on different sides of the shading facade. In one embodiment of the invention the flights of stairs can be manufactured using a metal pipe, racks 46—from tube 40×40 mm, steps 47—from tube 15×15 mm. The ladder is fixed by bolting to crossbars 6, 7 or 8 or by pairs of brackets 48 or other suitable method. Elements and accessories of the stairs can be connected to each other by welding or bolts.

One of the key advantages of the shading facade system of the invention is its reusability, ease of handling and manufacturing, as well as the ability to change, dismantle and recycle. If necessary, various modules or their components can be easily replaced or, for example, temporarily dismantled for repair. The design of the shading facade system makes it possible to remove any individual decorative module or several modules from the facade frame for maintenance or other reasons, without disturbing (or specifically removing) adjacent decorative modules. All components of the frame module and connecting components can be made from any material strong enough to maintain the required rigidity under any (or mostly expected) conditions while still providing the necessary support. In some cases, an overly rigid structure is not required; this means that some degree of flexibility of the entire decorative module (including the frame itself) may be preferred depending on where and for what purpose the module is intended to be used.

Modules, individually or as a group, can also be made waterproof for certain applications by stretching a waterproof material, such as a sheet or sheets of heavy-duty plastic, over the front of the module.

The shading facade according to the present invention, due to its design and insulation characteristics, can be used to create self-contained structures providing shelter from excessive heat, cold and wind, precipitation (including hail), even if they are not waterproofed. The decorative modules of the present invention can provide blocking/damping of light, heat transfer, hail and/or wind blows anywhere in many industries, including but not limited to: residential buildings, civil infrastructure buildings and structures, industrial plants, agriculture etc.

The decorative modules of the present invention can also be used as a sound absorbing panel or an acoustic panel.

The front side of the decorative module can be treated individually for UV protection or improved fire resistance. Therefore, the shading facade of the present invention may be important for building applications.

It has been discussed above that the present invention provides modular shading facade, spaced from the building wall, and consisting of various elements, including a set of frame module elements and a set of functional elements. The functional elements of the shading facade are decorative modules, stairs, grating, brackets for communications (for example, air conditioners, antennas, etc.). The frame module is attached to the facade of the building with a set of adjustable threaded studs.

What is claimed is:

1. A modular shading facade spaced from a building wall, comprising:

multiple decorative modules, each said module consisting of a rigid frame with outwardly extending legs connected to a frame by multiple receiving brackets, each said receiving bracket including a base and a stepped region connected to the base and formed by two angle shaped parts, each said part comprising first outer and second inner members having inner surfaces disposed at an angle to each other, wherein said inner surfaces of said inner members arranged to define an open space therebetween for receiving the respective leg;

a shading facade frame for adjusting position and fixation of said decorative modules, said frame including multiple primary bracket assemblies, each said primary bracket assembly formed by at least a base having a plurality of through openings, with a respective primary socket attached at the corresponding through openings, each said primary bracket is formed by interconnected angle shaped elements fixedly connected to said corresponding through openings for movably receiving said legs.

2. The modular shading façade according to claim 1, wherein changing insertion depth of the legs of the decorative module into the primary socket allows to adjust to allow adjustment of the deviation of the decorative module from the plane of the frame.

3. The modular shading façade according to claim 1, wherein a material stretched onto the frame of the decorative module is an elastic fabric material.

4. The modular shading façade according to claim 3, wherein said decorative frame further comprises horizontal and vertical elements having grooves with a stretched decorative material disposed within said elements utilizing a resilient cord, wherein fixation of the position of the stretched material to the frame is carried out by pressing the resilient cord into the grooves, after placing the decorative material into the respective groove the resilient cord is inserted there inside, so that the resilient cord presses and retains the decorative material within the groove along the entire perimeter of the frame of the decorative module.

5. The modular shading façade according to claim 1, wherein each said angle shaped part of said receiving bracket is formed with multiple projections for insertion into slots of the base to assure removable nature of a connection between the angle shaped parts and the base.

6. The modular shading façade according to claim 1, wherein said one angle shaped element of the primary brackets is formed with multiple protrusions and another corresponding angle shaped element is formed with multiple slotted groves, said angle shaped elements are interconnected to form a continuous nest having a square or rectangular cross-section by inserting said protrusions of said one element into the slotted grooves of the corresponding element.

7. A method utilizing the modular shading façade according to claim 5, comprising the step of adjusting a position of the decorative module using said legs and including setting a distance of each corner of the decorative module from the surface of the base and an angle between a surface of the decorative module frame and a peripheral plane of the shading facade frame, so that that the distance adjustment is carried out by inserting the legs into the primary bracket to a certain depth, wherein fixation of a predetermined position is carried out after the required position is set.

8. A method according to claim 7, wherein when the position of the decorative module is adjusted and corners of the frame of a lower decorative module are positioned close to the bracket base and position of upper corners of the decorative modules are away from the frame;

wherein the legs associated with the upper corners are outwardly extended from the base;

wherein changing a depth of insertion of the legs into the socket of the corresponding primary bracket for one of the four legs for each corner of the decorative module allows to adjust deviation of the decorative module from a peripheral plane of the frame module by a predetermined angle.

* * * * *